US008979560B2

(12) United States Patent
Kobayashi et al.

(10) Patent No.: US 8,979,560 B2
(45) Date of Patent: Mar. 17, 2015

(54) LEVER TYPE CONNECTOR

(75) Inventors: Tohru Kobayashi, Makinohara (JP); Tohru Suzuki, Fujieda (JP)

(73) Assignee: Yazaki Corporation, Tokyo (JP)

( * ) Notice: Subject to any disclaimer, the term of this patent is extended or adjusted under 35 U.S.C. 154(b) by 6 days.

(21) Appl. No.: 13/808,136

(22) PCT Filed: Jul. 7, 2011

(86) PCT No.: PCT/JP2011/066024

§ 371 (c)(1),
(2), (4) Date: Jan. 3, 2013

(87) PCT Pub. No.: WO2012/005381

PCT Pub. Date: Jan. 12, 2012

(65) Prior Publication Data

US 2013/0102172 A1 Apr. 25, 2013

(30) Foreign Application Priority Data

Jul. 9, 2010 (JP) ..... 2010-156802

(51) Int. Cl.
*H01R 13/62* (2006.01)
*H01R 13/629* (2006.01)

(52) U.S. Cl.
CPC ..... *H01R 13/62955* (2013.01)
USPC ..... 439/157

(58) Field of Classification Search
CPC ..... H01R 13/62955
USPC ..... 439/157
See application file for complete search history.

(56) References Cited

U.S. PATENT DOCUMENTS

| | | | | |
|---|---|---|---|---|
| 5,681,175 | A | 10/1997 | Busse et al. | |
| 5,888,081 | A | 3/1999 | Konoya et al. | |
| 8,684,756 | B2 * | 4/2014 | Kobayashi et al. | 439/157 |
| 2003/0008537 | A1 | 1/2003 | Nishide | |
| 2003/0181083 | A1 | 9/2003 | Kozono et al. | |

(Continued)

FOREIGN PATENT DOCUMENTS

| | | | |
|---|---|---|---|
| DE | 102004063242 | A1 | 8/2005 |
| DE | 102005047349 | A1 | 4/2007 |

(Continued)

OTHER PUBLICATIONS

International Search Report for PCT/JP2011/066024 dated Sep. 30, 2011 [PCT/ISA/210].

(Continued)

*Primary Examiner* — James Harvey
(74) *Attorney, Agent, or Firm* — Sughrue Mion, PLLC

(57) ABSTRACT

A lever type connector in which workability in inserting terminals is enhanced is provided. A lever type connector 1 includes a connector housing 22 for containing terminals 61 at terminal ends of wires, and a lever 30 which is rotatably mounted on the connector housing 22, and rotated at a wire extending side of the connector housing 22 thereby to move a mating connector to be engaged with the connector housing 22 up to a normally engaged position. The lever 30 includes a pair of arm parts 31 (31*a*, 31*b*), and a connecting part 38 for interconnecting respective base end parts 51 (51*a*, 51*b*) of the arm parts 31. A recess part 53 for enlarging a distance between the base end parts 51 is provided on at least one of inner walls 50 (50*a*, 50*b*) of the base end parts 51 of the arm parts 31 which are opposed to each other.

2 Claims, 9 Drawing Sheets

(56) References Cited

U.S. PATENT DOCUMENTS

| | | | | |
|---|---|---|---|---|
| 2005/0148221 | A1 | 7/2005 | Miyamoto | |
| 2006/0240693 | A1 | 10/2006 | Nishide | |
| 2008/0102668 | A1 | 5/2008 | Ikeya et al. | |
| 2010/0151714 | A1 | 6/2010 | Ambo et al. | |
| 2011/0070763 | A1 | 3/2011 | Kobayashi et al. | |
| 2013/0102168 | A1* | 4/2013 | Kobayashi et al. | 439/141 |
| 2013/0102172 | A1* | 4/2013 | Kobayashi et al. | 439/157 |

FOREIGN PATENT DOCUMENTS

| | | | |
|---|---|---|---|
| DE | 102010040998 | A1 | 4/2011 |
| EP | 1257013 | A1 | 11/2002 |
| JP | 08-250206 | A | 9/1996 |
| JP | H10-055853 | A | 2/1998 |
| JP | 2003-272755 | A | 9/2003 |
| JP | 2006-302769 | A | 11/2006 |
| JP | 2008288052 | A | 11/2008 |

OTHER PUBLICATIONS

Written Opinion for PCT/JP2011/066024 dated Sep. 30, 2011 [PCT/ISA/237].

Japanese Office Action and English translation thereof, dated Jul. 14, 2014, issued by the Japanese Patent Office in counterpart Japanese patent application No. 2010-156802.

Communication from the State Intellectual Property Office of the People's Republic of China issued Aug. 18, 2014 in a counterpart Chinese Application No. 201180034091.5.

Communication from the Japanese Patent Office dated Sep. 24, 2014, in a counterpart Japanese application No. 2010-156802.

Communication from the German Patent Office dated November 25, 2014 in a counterpart German application No. 112011102314.6.

* cited by examiner (a)

(b)

LEVER TYPE CONNECTOR

TECHNICAL FIELD

The present invention relates to a lever type connector which is so adapted as to be engaged with a mating connector, by rotating a lever.

BACKGROUND ART

As a lever type connector which is so adapted as to be engaged with a mating connector by rotating a lever, there has been conventionally proposed the lever type connector as disclosed, for example, in Japanese Patent Publication No. JP-A-2003-272755. This lever type connector has such a structure that by rotating the lever, the mating connector is introduced from a temporarily engaged position to a normally engaged position in a connector housing. In this manner, an engaging work can be easily performed, and reliability of the engaging work can be enhanced.

FIG. 9 is a view showing the structure of the lever type connector disclosed in JP-A-2003-272755. As shown in FIG. 9, the lever type connector 100 is substantially composed of a male connector 120 which can be engaged with and disengaged from a female connector (not shown), a lever 130 which is rotatably mounted on the male connector 120, and a wire cover 140 which has a substantially dome-like shape and guides out wires to the exterior.

The male connector 120 includes a connector housing 122 provided with a plurality of terminal containing rooms 121 for containing terminals (not shown) at terminal ends of the wires, and a rotation axis pin 123 for rotatably mounting the lever 130 on the connector housing 122.

The lever 130 is composed of a pair of arm parts 131, and a connecting part 138 for interconnecting these arm parts 131. The arm parts 131 is provided with a rotation axis hole 132 into which the rotation axis pin 123 of the connector housing 122 is inserted, a cam groove 133 for varying a distance from the rotation axis hole 132 along a circumferential direction of the arm parts 131, and an operating part 134 for operating the lever 130 to rotate. The operating part 134 has a locking part 135 for locking the lever 130 which has been rotated.

The wire cover 140 is composed of a cover body 141 which contains the wires which have been guided out from the connector housing 122 toward the wire cover 140, and guides out the wires to the exterior as a bundle of the wires, and a lock arm 142 which is provided on a top of the wire cover 140 in the substantially dome-like shape.

Then, an engaging work of the lever type connector 100 having the above described structure will be described. As a first step, the rotation axis pin 123 of the connector housing 122 is passed through the rotation axis hole 132 of the lever 130, thereby to mount the lever 130 on the connector housing 122 so as to rotate.

Thereafter, the terminals (not shown) at the terminal ends of the wires are inserted into the terminal containing rooms 121, and the wire cover 140 is assembled in a manner of covering the terminal containing rooms 121 of the connector housing 122. Then, the female connector (not shown) is inserted into the connector housing 122 of the male connector 120. A cam pin (not shown) of the female connector which has been inserted into the connector housing 122 is engaged with the cam groove 133 of the lever 130, thereby to set the female connector in a temporarily engaged position with respect to the connector housing 122.

Then, the lever 130 is rotated, and with this rotation of the lever 130, the cam pin (not shown) is pressed with a pressure from the cam groove 133 thereby to gradually shift the terminals of the female connector (not shown) to the normally engaged position in the connector housing 122.

When the lever 130 has arrived at a determined rotary position, the locking part 135 overrides the lock arm 142 which is provided on the lock cover 140, to be engaged with the lock arm 142. In this manner, the female connector (not shown) is engaged with the connector housing 122 in the normally engaged position.

Patent Document JP-A-2003-272755 is discussed above.

SUMMARY OF THE INVENTION

Technical Problem

However, in the conventional lever type connector 100 as described above, the lever 130 is mounted on the connector housing 122 in such a manner that a part of the lever 130 protrudes from the terminal containing rooms 121 of the connector housing 122 to a wire extending side. Accordingly, when the terminals at the terminal ends of the wires are clamped with fingers and inserted into the terminal containing rooms 121, the fingers may interfere with the lever 130. As the results, there occurs such a problem that it is difficult to insert the terminals in a normally inserted position, incurring deterioration of workability.

In view of the above, the invention has been made to solve the problem in the prior art as described above, and it is an object of the invention to provide a lever type connector in which workability in inserting terminals is enhanced.

Solution to Problem

In order to attain the above described object, there is provided according to the invention, as first aspect of the invention, a lever type connector comprising a connector housing for containing terminals at terminal ends of wires, and a lever which is rotatably mounted on the connector housing, and rotated at a wire extending side of the connector housing thereby to move a mating connector to be engaged with the connector housing up to a normally engaged position, characterized in that the lever includes a pair of arm parts, and a connecting part for interconnecting respective base end parts of the arm parts, a recess part for enlarging a distance between the base end parts is provided on at least one of inner walls of the base end parts of the arm parts which are opposed to each other, the connector housing is provided with a temporary lock projection for locking the lever in a temporarily locked position, on an outer peripheral face thereof, and the recess part is provided with a temporary lock engaging projection to be engaged with the temporary lock projection.

A lever type connector according to second aspect of the invention is the lever type connector as the first aspect of the invention, and characterized in that the recess part is formed in a shape of a shallow groove by reducing a thickness of the arm part, and the temporary lock engaging projection is formed having a height from a bottom of the recess part in the shape of a shallow groove to the thickness of the arm part.

A lever type connector according to third aspect of the invention is the lever type connector as the first or second aspect of the invention, and characterized in that the recess part is open to one side part of the lever, and the temporary lock engaging projection is formed in the other side part of the lever.

Advantageous Effect of Invention

According to the lever type connector according to the first aspect of the invention, the recess part for enlarging the distance between the base end parts of the arm parts is provided on at least one of the inner walls of the arm parts. As the results, the hand will not interfere with the lever, when the terminals at the terminal ends of the wires are inserted into the connector housing, and therefore, the terminals can be easily inserted into the normally inserted position.

Moreover, because the temporary lock projection is engaged with the temporary lock engaging projection which is formed in the recess part, the terminals at the terminal ends of the wires can be inserted, without rotating the lever. As the results, it is possible to provide the lever type connector in which workability in inserting the terminals is enhanced.

According to the lever type connector according to the second aspect of the invention, because the recess part is formed in the shape of a shallow groove by reducing the thickness of the arm part, it is possible to enlarge the distance between the base end parts, without making the thickness of the lever type connector larger.

Further, because the temporary lock engaging projection is formed having the height from the bottom of the recess part in the shape of a shallow groove to the thickness of the arm part, it is possible to hold the lever in the temporarily locked position, and to insert the terminals at the terminal ends of the wires, without making the thickness of the lever larger.

According to the lever type connector according to the third aspect of the invention, because the recess part is open to the one side part of the lever, the hand will not interfere with the lever, when the terminals at the terminal ends of the wires are inserted. Therefore, the terminals can be easily inserted into the normally inserted position, and the workability is enhanced. Moreover, because the temporary lock engaging projection is formed at the other side of the lever, there is no necessity of providing a projection separately on the lever. As the results, the number of constituent components is reduced, and reduction of the production cost can be achieved.

DESCRIPTION OF EMBODIMENTS

Figure 1:
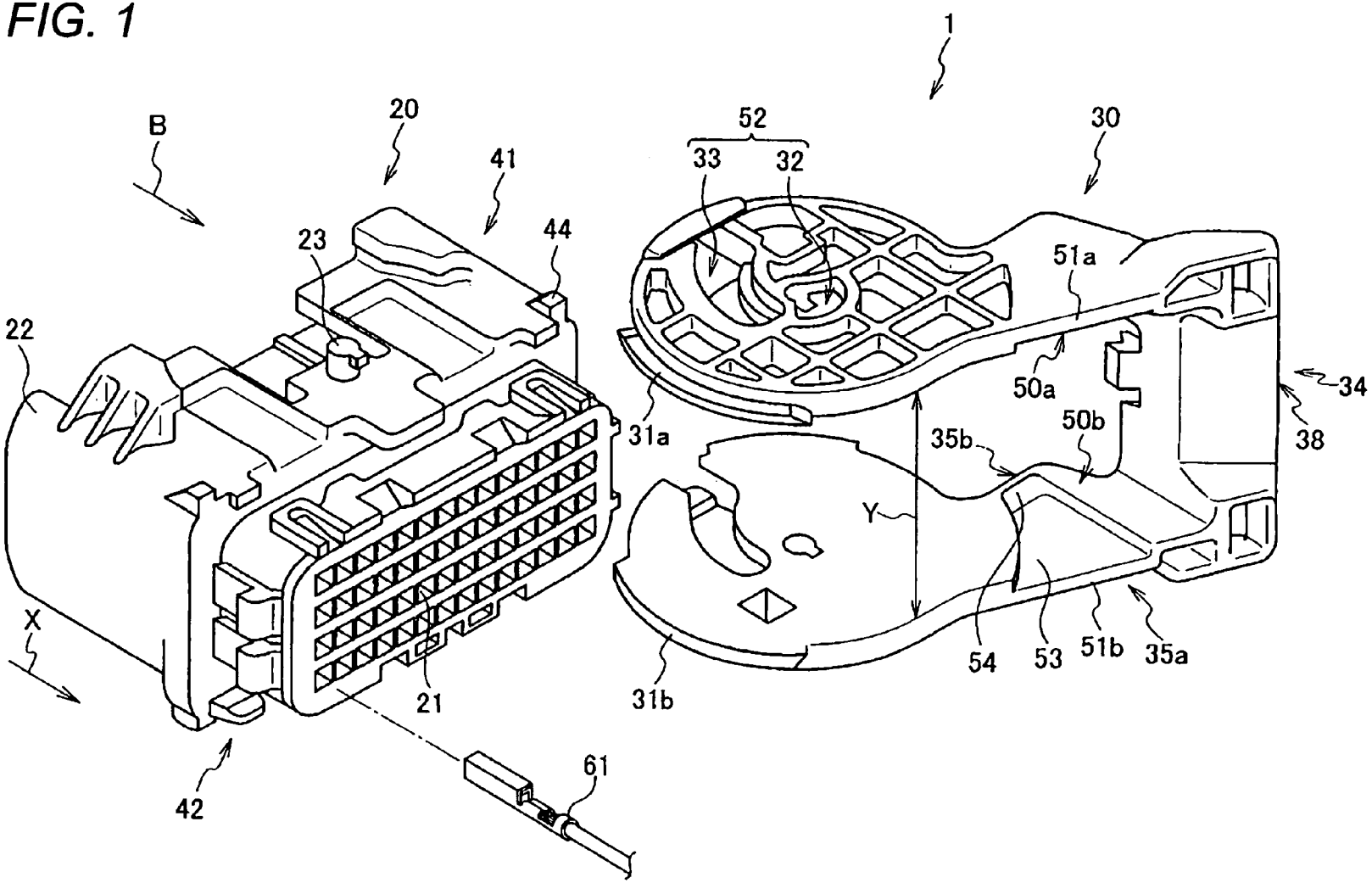
FIG. 1 is a perspective view of a lever type connector in an embodiment according to the invention, showing a state before a connector housing and a lever are assembled together.
Figure 2:
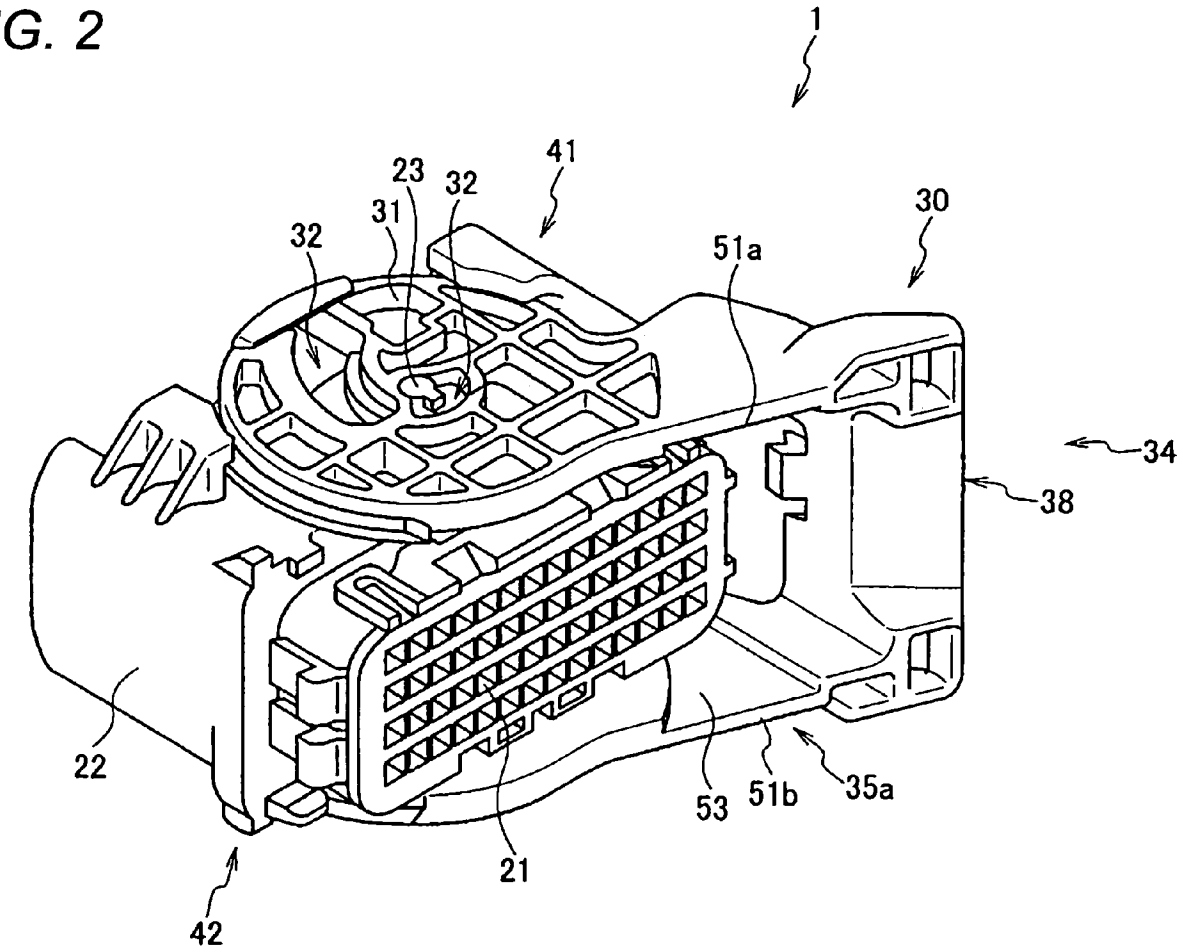
FIG. 2 is a perspective view of the lever type connector in the embodiment according to the invention, showing a state after the connector housing and the lever have been assembled together.
Figure 3:
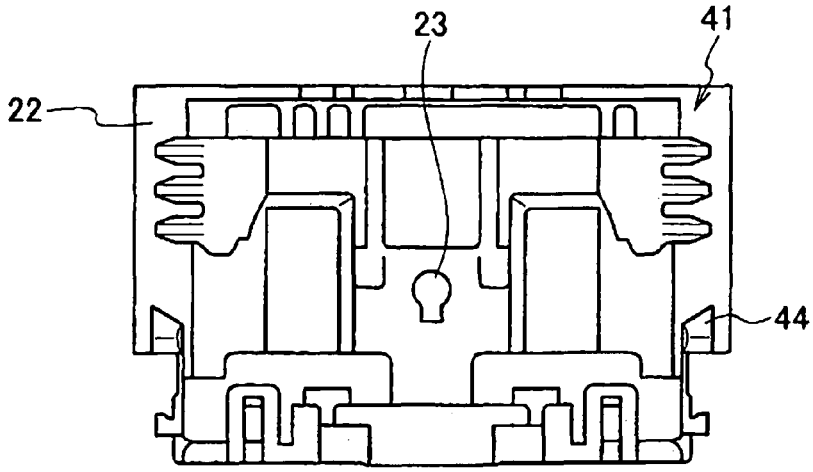
FIGS. 3(*a*) and (*b*) show plan views of the connector housing and the lever in the lever type connector in the embodiment according to the invention.
Figure 3:
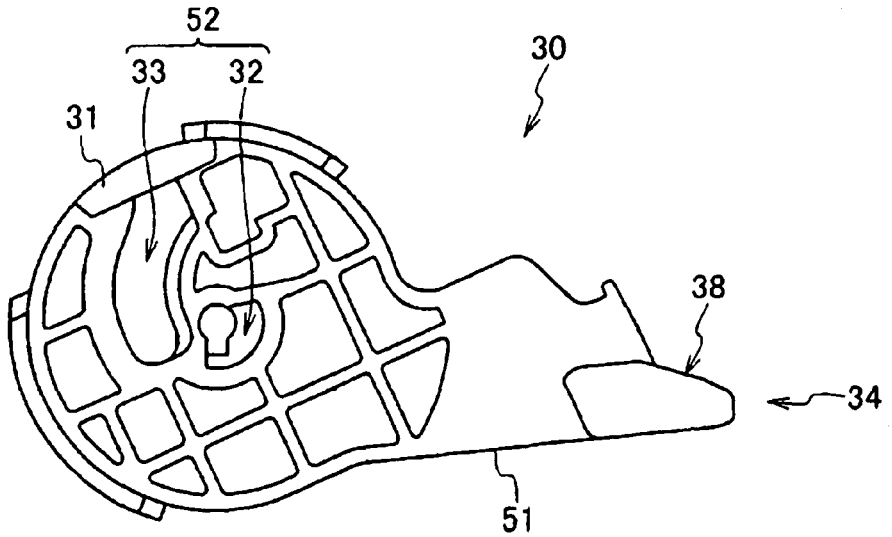

Now, an embodiment of the invention will be described referring to the drawings. FIG. 1 is a perspective view of a lever type connector in an embodiment according to the invention, showing a state before a connector housing and a lever are assembled together. FIG. 2 is a perspective view of the lever type connector in the embodiment according to the invention, showing a state after the connector housing and the lever have been assembled together. FIG. 3 is a plan view of the connector housing and the lever in the lever type connector in the embodiment according to the invention.

At the beginning, a structure of the lever type connector in the embodiment according to the invention will be described referring to FIGS. 1 to 3. The lever type connector in the embodiment according to the invention is so constructed that after the lever has been locked in a temporarily locked position, and terminals at terminal ends of wires have been inserted into a connector housing, the lever is rotated thereby to engage the connector housing with a mating connector in a normally engaged position.

As shown in FIGS. 1 to 3, a lever type connector 1 is substantially composed of a male connector 20 which can be engaged with a female connector (not shown), which is a mating connector, and can be disengaged from the female connector, and a lever 30 which is rotatably mounted on the male connector 20 and can be rotated at a wire extending side (See an arrow mark X in FIG. 1).

As shown in FIGS. 1 and 2, the male connector 20 has a connector housing 22 provided with terminal containing rooms 21 for containing a plurality of terminals 61 at terminal ends of the wires. As shown in FIGS. 1 to 3, this connector housing 22 is provided with rotation axis pins 23 for mounting the lever 30 on the connector housing 22 so as to rotate, and temporary lock projections 44 for locking the lever 30 in a temporarily locked position (See FIG. 5 which will be described below), on an outer peripheral face (an upper outer peripheral face 41 and a lower outer peripheral face 42) of the connector housing 22.

As shown in FIGS. 1 to 3, the temporary lock projections 44 have such a shape as protruding toward inner walls 50*a*, 50*b* of arm parts 31 which will be described below, when the lever 30 has been mounted on the connector housing 22. Then, when the lever 30 is rotated at the wire extending side (See the arrow mark X in FIG. 1) and has moved to the temporarily locked position (See FIG. 5 which will be described below), the temporary lock projections 44 are engaged with temporary lock engaging projections 54 which will be described below.

In this manner, the temporary lock projections 44 for locking the lever 30 in the temporarily locked position (See FIG. 5) are provided on the outer peripheral face (the upper outer peripheral face 41 and the lower outer peripheral face 42) of the connector housing 22. As the results, it is possible to hold the lever 30 in the temporarily locked position.

Moreover, because the temporary lock projections 44 are engaged with the temporary lock engaging projections 54 which are formed in recess parts 53, it is possible to insert the terminals 61 at the terminal ends of the wires, without rotating the lever 30. As the results, workability in inserting the terminals 61 can be enhanced.

As shown in FIG. 1, the lever 30 is substantially composed of a pair of the arm parts 31 (31*a*, 31*b*), an operating part 34 for operating the lever 30 to rotate, and a connecting part 38 for interconnecting the arm parts 31 (31*a*, 31*b*).

As shown in FIG. 1, base end parts 51 (51*a*, 51*b*) of the arm parts 31 are provided with the recess parts 53 for enlarging a distance Y between the base end parts 51*a* and 51*b* (a distance between a pair of the base end parts 51), and the temporary lock engaging projections 54 to be engaged with the temporary lock projections 44 provided on the connector housing 22, on inner walls 50*a*, 50*b* of the base end parts 51 opposed to each other.

In this manner, the recess parts 53 for enlarging the distance Y between the base end parts 51*a* and 51*b* of the arm parts 31 are provided on the inner walls 50*a*, 50*b* of the arm parts 31, and therefore, a hand will not interfere with the lever 30, when the terminals 61 at the terminal ends of the wires are clamped with fingers and inserted into the connector housing 22.

Moreover, because the distance Y between the base end parts 51*a* and 51*b* is enlarged by the recess parts 53, the terminals 61 at the terminal ends of the wires can be easily inserted into a normally inserted position, when the terminals 61 are inserted into the connector housing 22. As the results, it is possible to provide the lever type connector 1 in which the workability in inserting the terminals 61 is enhanced.

Each of the recess parts 53 is formed in a shape of a shallow groove by reducing a thickness of the arm part 31, as shown in FIG. 1, and is open toward one of side parts 35*a* of the lever 30. In other words, the recess part 53 has a long length shape extending from the other side part 35*b* to the one side part 35*a* of the lever 30 in a plan view, and the recess part 53 is formed thinner in thickness than the arm part 31, in a side view.

Because the recess part 53 is formed in the shape of a shallow groove by reducing the thickness of the arm part 31, as described above, the thickness of the lever type connector 1 will not be increased. Therefore, the lever type connector 1 can be made compact, while the distance Y between the base end parts 51*a* and 51*b* is enlarged.

Moreover, because the recess part 53 is open toward the one side part 35*a* of the lever 30, the hand will not interfere with the lever 30, when the terminals 61 at the terminal ends of the wires are clamped with the fingers and inserted. In short, the recess part 53 is formed in a wide area at the side where the terminals 61 are inserted (the one side part 35*a*), the hand will not interfere with the lever 30, when the terminals 61 are clamped with the fingers and brought close to the terminal containing rooms 21.

Further, because the hand will not interfere with the lever 30, the terminals 61 can be easily inserted into the terminal containing rooms 21 near the inner walls 50 of the arm part 31. As the results, the terminals 61 can be easily inserted into the normally inserted position, and the workability is enhanced.

Still further, because the temporary lock engaging projection 54 is formed in the other side part 35*b*, there is no necessity of providing a projection separately on the lever 30. As the results, the number of constituent components is reduced, and reduction of production cost can be achieved.

As shown in FIG. 1, the temporary lock engaging projection 54 is formed having a height from a bottom of the recess part 53 in the shape of a shallow groove to the thickness of the arm part 31. In short, the temporary lock engaging projection 54 is inclined at a determined angle with respect to the bottom of the recess part 53.

As described above, the temporary lock engaging projection 54 is formed having the height from the bottom of the recess part 53 in the shape of a shallow groove to the thickness of the arm part 31. Therefore, it is possible to insert the terminals 61 at the terminal ends of the wires by holding the lever 30 in the temporarily locked position (See FIG. 5), without making the thickness of the lever type connector 1 larger.

As shown in FIG. 1, each of the arm parts 31 is provided with a cam groove forming part 52 in an end part thereof at an opposite side to the connecting part 38 interposing the base end part 51. The cam groove forming part 52 is provided with a rotation axis hole 32 into which the rotation axis pin 23 of the connector housing 22 is inserted, and a cam groove 33 to be engaged with a cam pin (not shown) of the female connector.

In this manner, the cam groove forming parts 52 are formed in the end parts at the opposite side to the connecting part 38 interposing the base end parts 51*a*, 51*b*. Therefore, when the recess parts 53 and the temporary lock engaging projections 54 are engaged with the mating connector (not shown), the workability in inserting the terminals 61 at the terminal ends of the wires can be enhanced, without badly affecting an engaging work.

Figure 4:
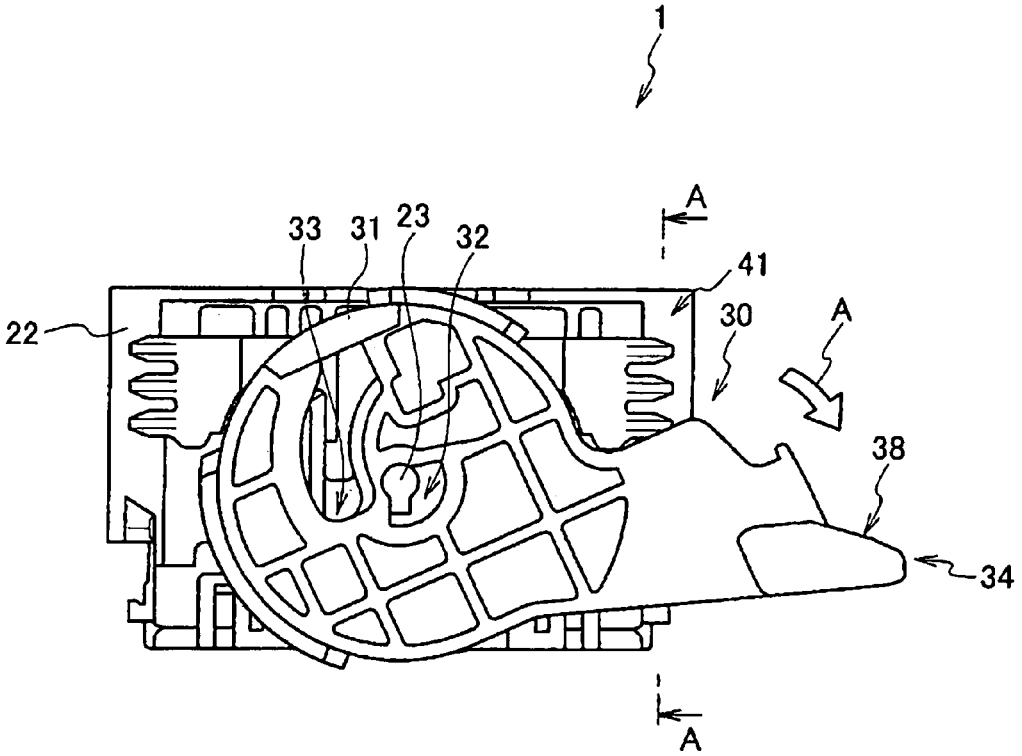
FIG. 4 is a plan view of the lever type connector in the embodiment according to the invention, showing a state after the connector housing and the lever have been assembled together.
Figure 5:
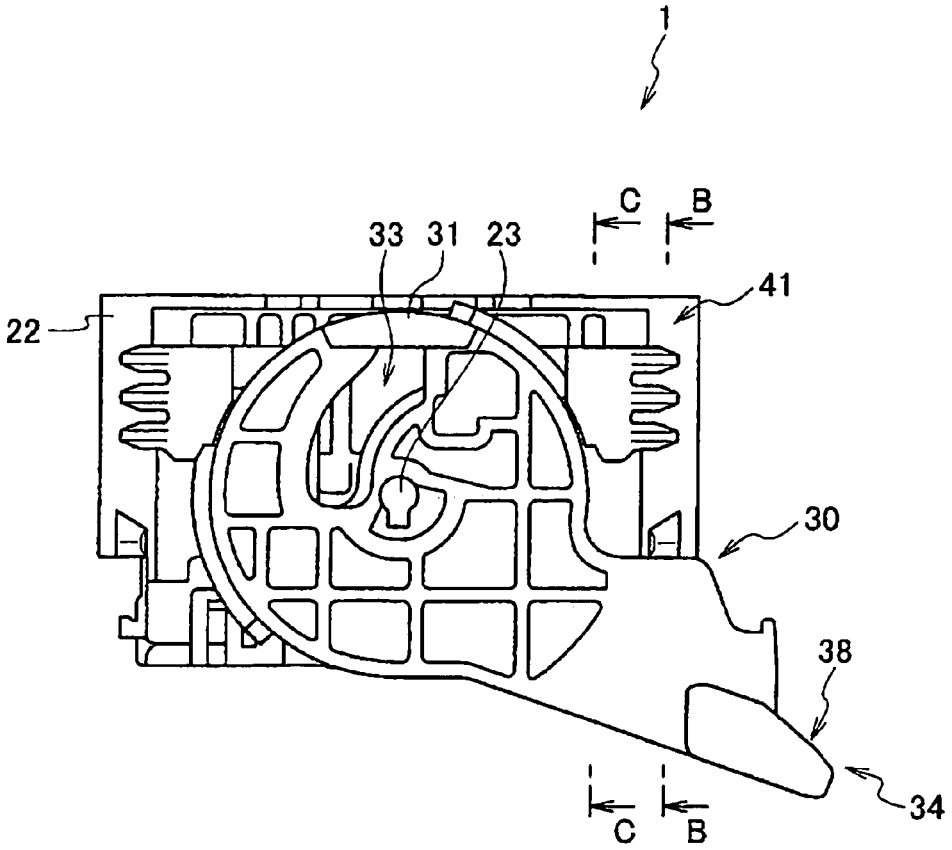
FIG. 5 is a plan view of the lever type connector in the embodiment according to the invention, showing a temporarily locked state of the lever.
Figure 6:
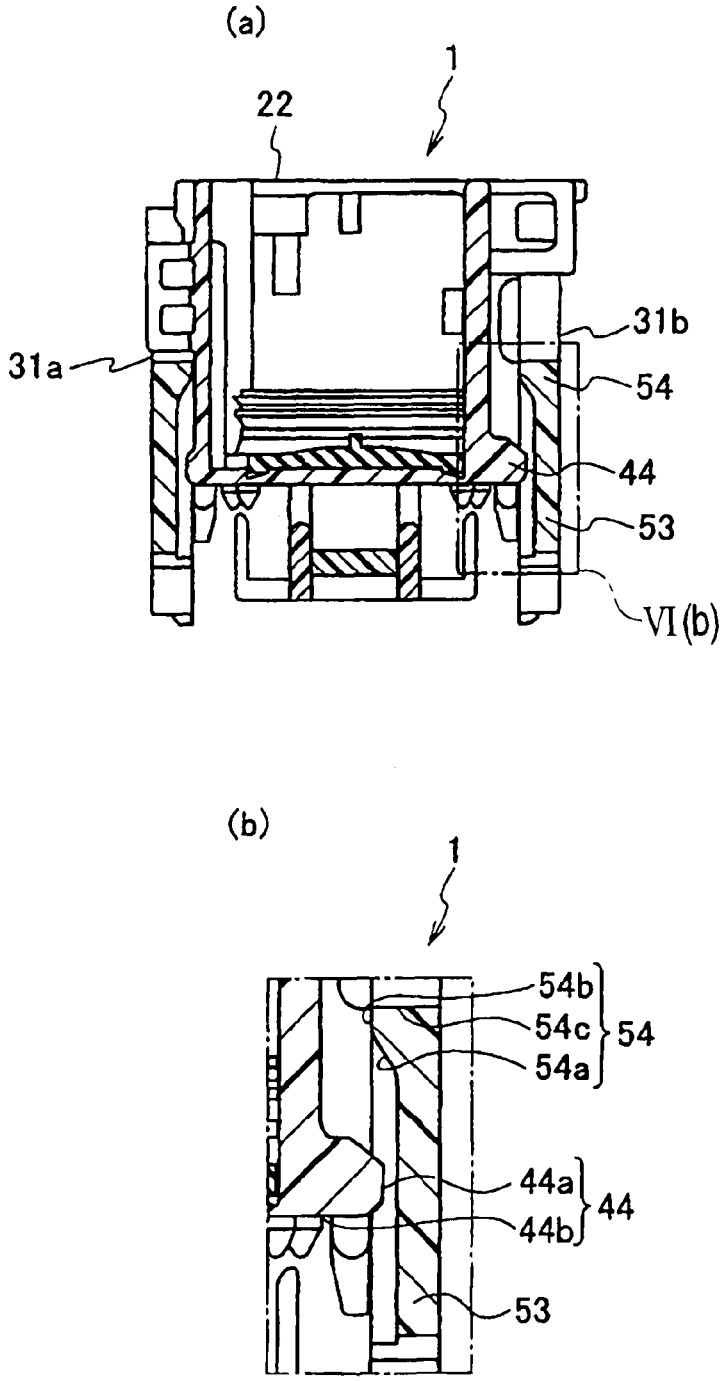
FIG. 6(*a*) shows a sectional view of the lever type connector in the embodiment according to the invention, taken along a line A-A in FIG. 4 and FIG. 6(*b*) shows an enlarged view of a part VI(b) indicated in FIG. 6(*a*).
Figure 7:
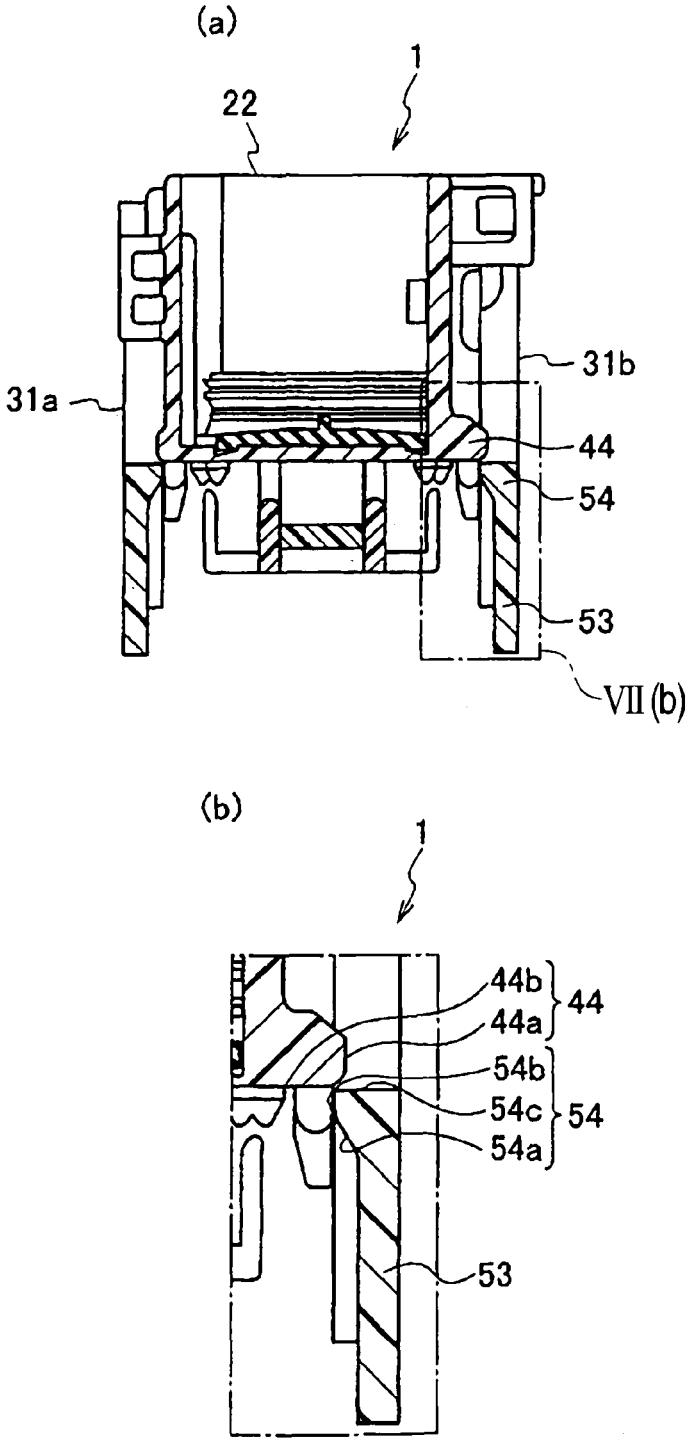
FIG. 7(*a*) shows a sectional view of the lever type connector in the embodiment according to the invention, taken along a line B-B in FIG. 5 and FIG. 7(*b*) shows an enlarged view of a part VII (b) indicated in FIG. 7(*a*).
Figure 8:
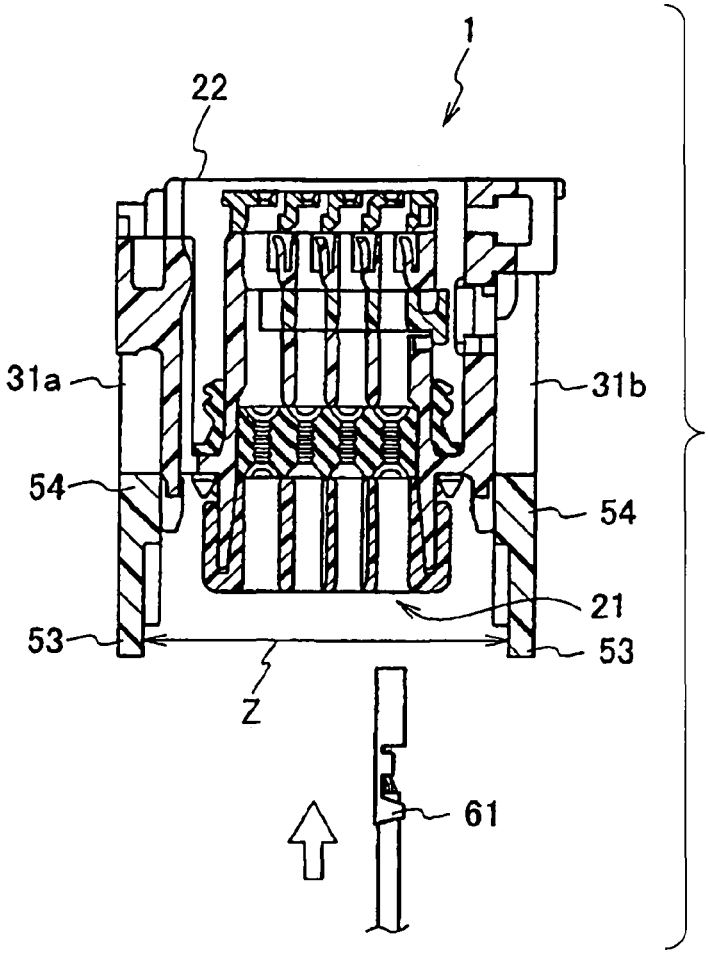
FIG. 8 is a sectional view of the lever type connector in the embodiment according to the invention, taken along a line C-C in FIG. 5.
Figure 9:
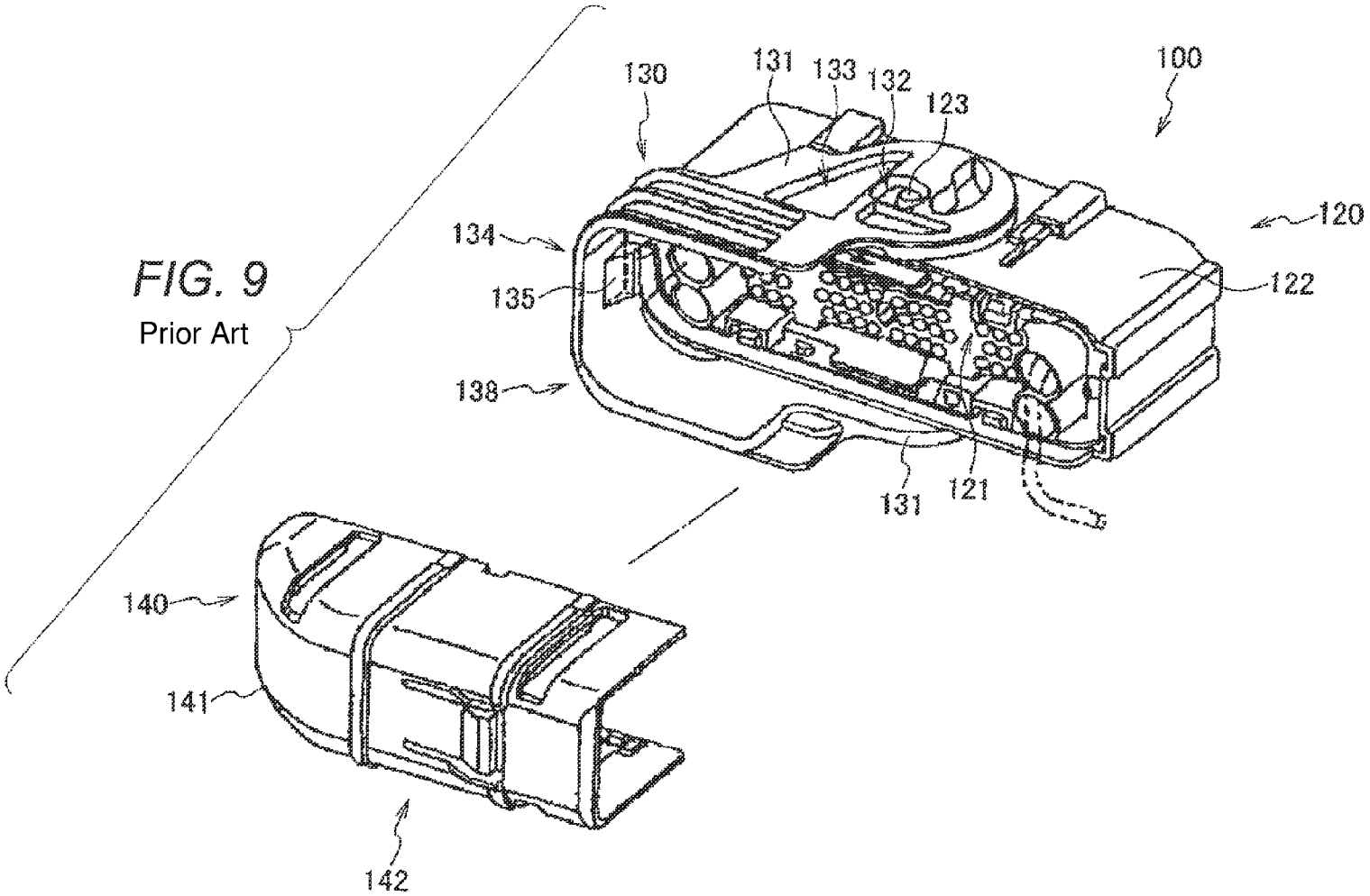
FIG. 9 Prior Art
FIG. 9 is a perspective view of a lever type connector in a conventional case.

Then, referring to FIGS. 4 to 8, the engaging work of the lever type connector 1 in the embodiment according to the invention will be described. FIG. 4 is a plan view of the lever type connector in the embodiment according to the invention, showing a state after the connector housing and the lever have been assembled together. FIG. 5 is a plan view of the lever type connector in the embodiment according to the invention, showing a temporarily locked state of the lever. FIG. 6(*a*) shows a sectional view of the lever type connector in the embodiment according to the invention, taken along a line A-A in FIG. 4 and FIG. 6(*b*) shows an enlarged view of a part VI (b) indicated in FIG. 6(*a*). FIG. 7(*a*) shows a sectional view of the lever type connector in the embodiment according to the invention, taken along a line B-B in FIG. 5 and FIG. 7(*b*) shows an enlarged view of a part VII (b) indicated in FIG. 7(*a*). FIG. 8 is a sectional view of the lever type connector in the embodiment according to the invention, taken along a line C-C in FIG. 5.

As a first step, as shown in FIG. 4, the rotation axis pin 35 of the connector housing 22 is passed through the rotation axis hole 32 of the lever 30 thereby to mount the lever 30 on the connector housing 22 so as to rotate.

When the lever 30 is mounted on the connector housing 22, as shown in FIG. 6(*a*), a projected part 44*a* of the temporary lock projection 44 of the connector housing 22 is positioned between the recess part 53 of the arm part 31 (between the one side part 35*a* and the temporary lock engaging projection 54), as shown in FIG. 6(*b*).

Specifically, when the lever 30 is mounted on the connector housing 22, the projected part 44*a* of the temporary lock projection 44 which is shown in FIG. 6(*b*) is butted against the inclined part 54*a* of the temporary lock engaging projection 54, and thus, the lever 30 is restrained from rotating in a direction of an arrow mark A in FIG. 4.

Then, as shown in FIG. 5, the operating part 34 of the lever 30 is operated to rotate the lever 30 in the direction of the arrow mark A in FIG. 4, thereby to lock the lever 30 in the temporarily locked position. Herein, the temporarily locked position means that the operating part 34 of the lever 30 is positioned near the terminal containing rooms 21 (See FIG. 1) into which the terminals 61 are to be inserted.

Specifically, when the lever 30 is rotated in the direction of the arrow mark A in FIG. 4, the projected part 44*a* of the temporary lock projection 44, as shown in FIG. 7(*b*), is butted against the inclined part 54*a* of the temporary lock engaging projection 54. As the lever 30 is further rotated, the projected part 44*a* overrides an inclined head part 54*b* of the temporary lock engaging projection 54. When the projected part 44*a* has overridden the inclined head part 54*b* of the temporary lock engaging projection 54, a temporarily locking flat part 44*b* of the temporary lock projection 44 is positioned on the substantially same plane as a flat part 54*c* of the temporary lock engaging part 54, as shown in FIG. 7(*b*), and the lever 30 is locked in the temporarily locked position.

In this manner, when the projected part 44*a* of the temporary lock projection 44 has overridden the inclined head part 54*b* of the temporary lock engaging projection 54, the lever 30 is locked in the temporarily locked position. Therefore, interference between the temporary lock projection 44 and the lever 30 is depressed to the least, while the lever 30 is shifted to the temporarily locked position (See FIGS. 4 and 5), and hence, the lever 30 can be easily mounted on the connector housing 22.

The projected part 44*a* of the temporary lock projection 44 may be formed of an elastic member which is flexibly deformed toward the terminal containing rooms 21 (See FIG. 1), so that the projected part 44*a* can override the inclined head part 54*b* of the temporary lock engaging projection 54. Moreover, the inclined head part 54*b* of the temporary lock engaging projection 54 may be also formed of an elastic member which is flexibly deformed toward the recess part 53, so that the projected part 44*a* can override the inclined head part 54*b*.

After the lever 30 has been rotated to be locked in the temporarily locked position, the terminals 61 at the terminal ends of the wires are inserted into the terminal containing rooms 21, as shown in FIG. 8. When the terminals 61 at the terminal ends of the wires are inserted, a distance Z between the arm part 31*a* and the arm part 31*b* is larger than a distance between the conventional arm parts, because the recess parts 53 in the shape of a shallow groove are formed. Therefore, the inserting work of the terminals 61 at the terminal ends of the wires can be easily performed.

Moreover, because the recess parts 53 in the shape of a shallow groove are formed, the fingers enter up to a position near the terminal containing rooms 21, when the terminals 61 at the terminal ends of the wires are inserted into the terminal containing rooms 21, and a distance from the fingers clamping the terminal ends 61 to the terminal containing rooms 21 is reduced. As the results, the inserting work of the terminals 61 at the terminal ends of the wires can be easily performed. Further, it is possible to prevent a break or so of the wire which occurs due to a long distance between the fingers clamping the terminal ends 61 and the terminal containing rooms 21, when the terminals 61 are inserted into the terminal containing rooms 21.

After the terminals 61 at the terminal ends of the wires have been inserted into the terminal containing rooms 21, a wire cover (not shown) is assembled in a manner of covering over the terminal containing rooms 21 of the connector housing 22, and the female connector (not shown) is inserted into the connector housing 22 of the male connector 20 from a direction of an arrow mark B in FIG. 1. A cam pin (not shown) of the female connector which is inserted into the connector housing 22 is engaged with a cam groove 33 of the lever 30 thereby to set the female connector in a temporarily engaged position with respect to the connector housing 22.

Then, the lever 30 which stays in the temporarily locked position is further rotated in the direction of the arrow mark A in FIG. 4. The cam pin (not shown) is pressed with a pressure from the cam groove 33 with this rotation of the lever 30, and the terminals (not shown) of the female connector are gradually shifted to a normally engaged position of the connector housing 22. In this manner, the female connector and the connector housing 22 are normally engaged with each other.

As described above, the lever type connector 1 in the embodiment according to the invention includes the connector housing 22 for containing the terminals 61 at the terminal ends of the wires, and the lever 30 which is rotatably mounted on the connector housing 22, and rotated at the wire extending side (the arrow mark X in FIG. 1) of the connector housing 22 thereby to move a mating connector to be engaged with the connector housing 22 up to the normally engaged position. The lever 30 includes a pair of the arm parts 31 (31*a*, 31*b*), and the connecting part 38 for interconnecting the respective base end parts 51 (51*a*, 51*b*) of the arm parts 31. The recess part 53 for enlarging a distance between the base end parts 51 is provided on at least one of the inner walls 50 (50*a*, 50*b*) of the base end parts 51 of the arm parts 31 which are opposed to each other.

Moreover, the connector housing 22 is provided with the temporary lock projection 44 for locking the lever 30 in the temporarily locked position, on an outer peripheral face thereof (the upper outer peripheral face 41, the lower outer peripheral face 42), and the temporary lock engaging projection 54 to be engaged with the temporary lock projection 44 is formed in the recess part 53.

Further, in the lever type connector 1 in the embodiment according to the invention, the recess part 53 is formed in the shape of a shallow groove by reducing the thickness of the arm part 31, and the temporary lock engaging projection 54 is formed having the height from the bottom of the recess part 53 in the shape of a shallow groove to the thickness of the arm part 31.

Moreover, the lever 30 is provided with the cam groove forming part 52 in which the cam groove 33 to be engaged with the cam pin of the mating connector is formed, at the opposite end part to the connecting part 38 interposing the base end part 51.

Further, in the lever type connector 1 in the embodiment according to the invention, the recess part 53 is open to the one side part 35*a* of the lever 30, and the temporary lock engaging projection 54 is formed in the other side part 35*b*.

According to the lever type connector 1 in the embodiment according to the invention, the recess part 53 for enlarging the distance Y between the base end parts 51*a*, 51*b* of the arm parts 31 is provided on the inner wall 50*a* or 50*b* of the arm parts 31. As the results, the hand will not interfere with the lever 30, when the terminals 61 at the terminal ends of the wires are inserted into the connector housing 22.

Moreover, because the distance Y between the base end parts 51*a*, 51*b* is enlarged by the recess part 53, the terminals 61 can be easily inserted into the normally inserted position, when the terminals 61 at the terminal ends of the wires are inserted into the connector housing 22. Therefore, it is possible to provide the lever type connector 1 in which the workability in inserting the terminals 61 is enhanced.

Moreover, because the connector housing 22 is provided with the temporary lock projection 44 for locking the lever 30 in the temporarily locked position (See FIG. 5), on an outer peripheral face thereof (the upper outer peripheral face 41, the lower outer peripheral face 42), it is possible to hold the lever 30 in the temporarily locked position.

Further, the temporary lock projection 44 is engaged with the temporary lock engaging projection 54 which is formed in the recess part 53. Therefore, it is possible to insert the terminals 61 at the terminal ends of the wires, without rotating the lever 30.

Moreover, according to the lever type connector 1 of the invention, because the recess part 53 is formed in the shape of a shallow groove by reducing the thickness of the arm part 31, it is possible to enlarge the distance Y between the base end part 51*a* and the base end part 51*b*.

Further, because the temporary lock engaging projection 54 is formed having the height from the bottom of the recess part 53 in the shape of a shallow groove to the thickness of the arm part 31, it is possible to hold the lever 30 in the temporarily locked position (See FIG. 5), and to insert the terminals 61 at the terminal ends of the wires, without making the thickness of the lever 30 larger.

Moreover, the cam groove forming part 52 is formed at the opposite end part to the connecting part 38 interposing the base end part 51*a*, 51*b*. Therefore, when the recess part 53 and the temporary lock engaging projection 54 are engaged with the mating connector (not shown), the workability in inserting the terminals 61 at the terminal ends of the wires can be enhanced, without badly affecting the engaging work.

Further, according to the lever type connector 1 of the invention, because the recess part 53 is open to the one side part 35*a* of the lever 1, the hand will not interfere with the lever 30, when the terminals 61 at the terminal ends of the wires are inserted. Therefore, the terminals 61 can be easily inserted into the normally inserted position, and hence, the workability is enhanced. Moreover, because the temporary lock engaging projection 54 is formed in the other side part 35*b* of the lever 30, there is no necessity of providing a projection separately on the lever 30. As the results, the number of constituent components is reduced, and reduction of the production cost can be achieved.

Although the lever type connector according to the invention has been heretofore described referring to the illustrated embodiment, the invention is not limited to the embodiment, but structures of the respective parts can be substituted with desired structures having the substantially same functions.

For example, in the above described embodiment, a case where the recess parts 53 are provided on both the inner wall 50*a* and the inner wall 50*b* of the base end parts 51 has been described. However, the recess part 53 may be provided on either one of the inner wall 50*a* and the inner wall 50*b*.

Moreover, in the above described embodiment, a case where the recess part 53 has a long length shape from the other side part 35*b* of the lever 30 to the one side part 35*a* has been described. However, a shape of the recess part 53 can be appropriately modified, provided that it has such a shape as enlarging the distance Y between the base end part 51*a* and the base end part 51*b*.

The present application is based on Japanese Patent Application No. 2010-156802 filed on Jul. 9, 2010, the entire contents of which are incorporated herein by reference.

Industrial Applicability

This invention is extremely useful in enhancing the workability, on occasion of inserting the terminals into the lever type connector which is so adapted as to be engaged with a mating connector, by rotating a lever.

REFERENCE SIGNS LIST

1 Lever type connector
20 Male connector
21 Terminal containing room
22 Connector housing
23 Rotation axis pin
30 Lever
31 Arm part
32 Rotation axis hole
33 Cam groove
34 Operating part
35*a* One side part
35*b* Other side part
38 Connecting part
41 Upper outer peripheral face
42 Lower outer peripheral face
44 Temporary lock projection
44*a* Projected part
44*b* Temporarily locking flat part
50 Inner wall
51 Base end part
52 Cam groove forming part
53 Recess part
54 Temporary lock engaging projection
54*a* Inclined part
54*b* Inclined head part
54*c* Temporary lock engaging flat part
61 Terminal at terminal end of wire

The invention claimed is:

1. A lever type connector comprising:

a connector housing for containing terminals at terminal ends of wires, and a lever which is rotatably mounted on the connector housing, and rotated at a wire extending side of the connector housing thereby to move a mating connector to be engaged with the connector housing up to a normally engaged position, wherein the lever includes a pair of arm parts, and a connecting part for interconnecting respective base end parts of the arm parts, a recess part for enlarging a distance between the base end parts is provided on at least one of inner walls of the base end parts of the arm parts which are opposed to each other, the connector housing is provided with a temporary lock projection for locking the lever in a temporarily locked position, on an outer peripheral face thereof, and the recess part is provided with a temporary lock engaging projection to be engaged with the temporary lock projection, and the recess part is open to one side part of the lever, and the temporary lock engaging projection is formed in the other side part of the lever.

2. A lever type connector as claimed in claim 1, wherein the recess part is formed in a shape of a shallow groove by reducing a thickness of the arm part, and the temporary lock engaging projection is formed having a height from a bottom of the recess part in the shape of a shallow groove to the thickness of the arm part.

* * * * *